US006044627A

United States Patent [19]

de Guglielmo

[11] Patent Number: 6,044,627

[45] Date of Patent: Apr. 4, 2000

[54] DEVICE FOR CONVEYING PLASTIC POTS IN THE TRANSVERSE DIRECTION AT HIGH SPEED

[75] Inventor: Pascal de Guglielmo, Montgueux, France

[73] Assignee: Aries Packaging, Breviandes, France

[21] Appl. No.: 09/048,297

[22] Filed: Mar. 26, 1998

[30] Foreign Application Priority Data

Mar. 26, 1997 [FR] France ..... 97 03702

[51] Int. Cl.[7] ..... B65B 35/46

[52] U.S. Cl. ..... 53/543; 53/48.7; 53/48.8; 53/540; 198/377.03; 198/377.07; 198/475.1; 198/797

[58] Field of Search ..... 53/48.6, 48.7, 53/48.8, 540, 543; 198/377.03, 377.07, 430, 475.1, 797, 798, 799

[56] References Cited

U.S. PATENT DOCUMENTS

| | | | |
|---|---|---|---|
| 3,868,009 | 2/1975 | Billi et al. . | |
| 4,066,162 | 1/1978 | Miaskoff . | |
| 4,283,973 | 8/1981 | Spencer . | |
| 4,408,686 | 10/1983 | Taverna . | |
| 4,645,063 | 2/1987 | Seragnoli . | |
| 4,883,163 | 11/1989 | Gamberini et al. . | |
| 5,154,039 | 10/1992 | De Guglielmo | 53/48.7 X |
| 5,188,212 | 2/1993 | Munsch . | |
| 5,318,165 | 6/1994 | Spatafora et al. . | |
| 5,381,884 | 1/1995 | Spatafora et al. . | |
| 5,400,574 | 3/1995 | Spatafora | 53/531 |
| 5,417,037 | 5/1995 | Osti et al. | 53/544 X |
| 5,647,190 | 7/1997 | Minarelli et al. | 53/544 X |

FOREIGN PATENT DOCUMENTS

| | | |
|---|---|---|
| 2 113 232 | 6/1972 | France . |
| 26 52 544 | 6/1977 | Germany . |
| 84 14 263 | 10/1985 | Germany . |
| 1 279 486 | 6/1972 | United Kingdom . |
| WO 95/07840 | 3/1995 | WIPO . |

*Primary Examiner*—Daniel B. Moon
*Attorney, Agent, or Firm*—Young & Thompson

[57] ABSTRACT

A device for displacing articles from a first substantially rectilinear feed track (23) to a second substantially rectilinear feed track (24) forming an angle with the first track (23), comprises apparatus (26) for grouping articles in batches of at least two articles; apparatus (27) for grasping the batches of articles formed; and apparatus for driving the grasping apparatus along a closed circuit (28). Along the closed circuit there is a station (29) where the batches of articles are seized batchwise by the grasping apparatus, at the end of the first feed track (23); and a station (30) where the batches of articles are released batchwise by the grasping apparatus, at the beginning of the second feed track (24). At the seizing station (29), the articles of each batch of articles are aligned in a first direction of alignment substantially parallel to the first feed track (23), and at the releasing station (30), the articles of each batch of articles are aligned perpendicular to the second feed track (24).

7 Claims, 4 Drawing Sheets

DEVICE FOR CONVEYING PLASTIC POTS IN THE TRANSVERSE DIRECTION AT HIGH SPEED

According to a first aspect, the invention relates to a device for displacing articles such as plastic pots or equivalent.

According to a second aspect, the invention relates to a machine for packaging plastic pots or equivalent comprising at least one device such as the one mentioned above.

The displacement of plastic pots, such as those used in the foodstuff industry, is usually difficult to achieve at high speeds when the pots are individualised.

Indeed, due to their shape, these pots are generally relatively unstable, their base being smaller than their top. This is usually the case with pots containing dairy products, for example.

After the pots exit the filling and closing machine, with the closing achieved by lidding for example, they are separated, according to a pot lap, into groups of pots, conventionally into pairs of pots.

The pairs of pots, which are mechanically more stable than the individualised pots, may be conveyed at high speeds.

In order for it to be possible to freely choose the number of pots to be grouped together and packed in the marketed product ("pack"), it is nevertheless preferable to dispose of individualised pots when packing the pots.

According to a first aspect, the invention relates to a device allowing for a continuous, high-speed transfer, in the transverse direction, of groups of pots such as pairs of pots, towards a pot separation station forming said groups of pots.

According to a second aspect, the invention relates to a machine for packaging plastic pots or equivalent comprising at least one device such as the one mentioned above.

Such a machine makes it possible, in particular, to package pots in groups comprising a number of pots not necessarily a multiple of two.

For this purpose, the invention relates to a device for displacing articles such as plastic pots or equivalent, from a first substantially rectilinear feed track to a second substantially rectilinear feed track forming an angle with said first track, said device comprising:

- means for grouping the articles in batches of two or more articles;
- means for grasping the batches of articles formed;
- means for driving said grasping means along a closed circuit comprising:
  - a station where the batches of articles are seized by the grasping means, located plumb with the first feed track;
  - a station where the batches of articles are released by the grasping means, located plumb with the second feed track, such that, at the seizing station, the articles of each batch of articles are aligned in a first direction of alignment substantially parallel to the first feed track, whereas at the releasing station, the articles of each batch of articles are aligned in a second direction of alignment substantially perpendicular to the second feed track.

In one embodiment, the first direction of alignment is substantially identical to the second direction of alignment.

The first and second feed tracks are substantially flat and perpendicular.

According to one characteristic, the means for driving the grasping means comprise a circular conveyor with several carrier pinions, a means for grasping batches of articles being secured to each carrier pinion in a removable manner.

The circular conveyor comprises a main driving shaft, intermediate pinions connecting this main driving shaft to the carrier pinions.

Each grasping means comprises:

- a slide of which a first end forms a clamp for grasping a batch of articles;
- a lever of which a first end is associated with the second end of the slide, the second end of this lever carrying a roller rolling on a fixed cam, this lever being arranged along a radial direction of the circular conveyor and capable of rocking in a tangential direction defined by a pin support,
  - said fixed cam comprising protuberances on which the roller passes, driving the slide from an upper position in which the pots are seized to a lower position in which the pots are released.

The invention also relates to a machine for packaging plastic pots or equivalent, comprising at least one device such as the one described above.

Said machine further comprises a station for blanking batches of articles into individualised articles, the lines of separation of the articles being parallel to the direction of conveyance of the second feed track.

Said machine further comprises, in one embodiment, elements for diverting and steering the individualised articles towards devices for grouping and spacing out articles.

Said machine further comprises, in one embodiment:

- a line for supplying a blank made of cardboard or an analogous material;
- a station for installing a first group of articles, coming from the grouping and spacing means, on a panel of the blank;
- a station for installing an insert above the first group of articles forming the bottom layer of the final product;
- a station for installing a second group of articles, coming from the grouping and spacing means, and forming the top layer of the final product;
- stations for folding and fastening the side flaps of the blank, so as to form the pack of the final product.

Further objects and advantages of the invention will be more clearly understood upon reading the description which follows of an embodiment, this description being made with reference to the attached drawings, in which.

Figure 1:
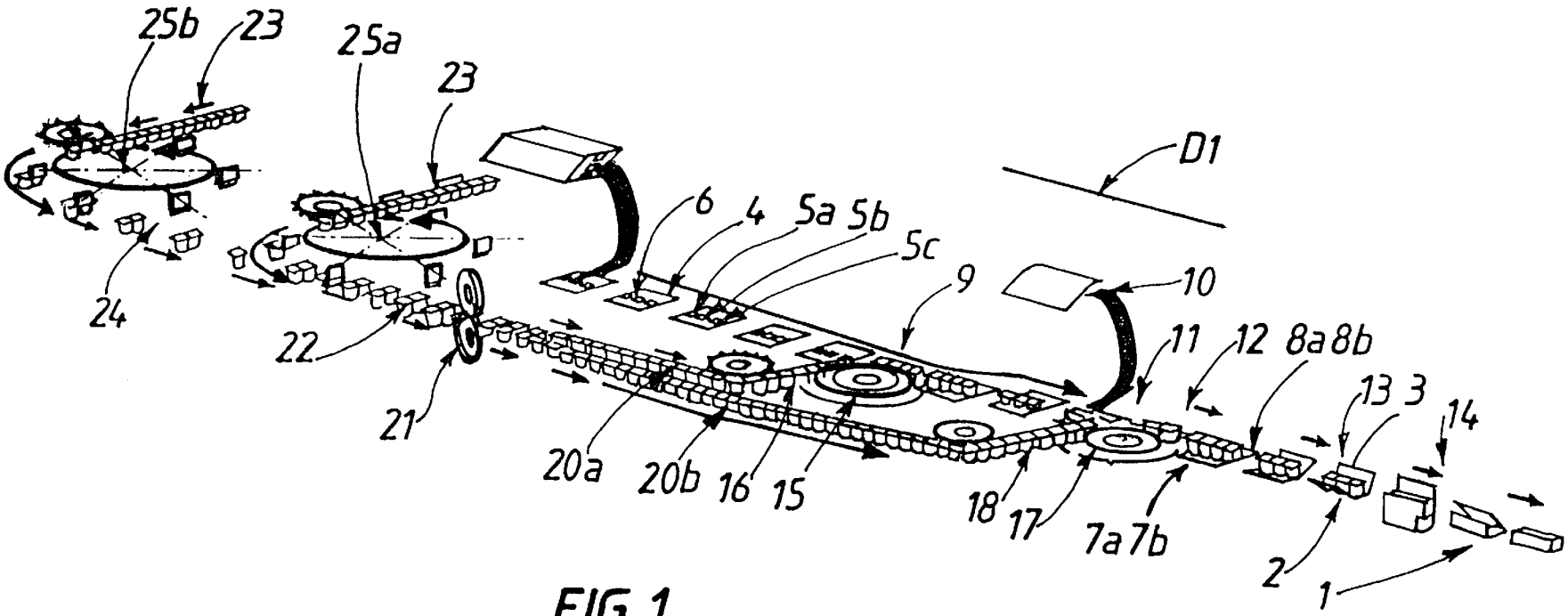
FIG. 1 is a schematic view of a packaging machine according to the invention.

Reference will first be made to FIG. 1.

FIG. 1 is a schematic representation of a machine for packaging articles such as thermoformed plastic pots.

In the embodiment shown in FIG. 1, each final product 1 produced with the packaging machine comprises six pots made of plastic or an equivalent material.

These six pots are arranged in two layers, i.e. a bottom layer 2 comprising three pots and a top layer 3 comprising three other pots.

Each of the pots of the top layer 3 is placed plumb with and above a pot of the bottom layer 2.

The six pots of each final product 1 comprise a substantially flat upper rim capable of supporting a strippable lid.

The upper rims of the pots placed side by side in the bottom layer 2 or in the top layer 3 are not assembled at their edges facing each other.

In other words, there is no break or blanking line between the upper rims of two neighbouring pots in the same layer and the neighbouring pots are placed apart from one another.

The cohesion of the assembly formed by the six pots distant from one another in each final product 1 is ensured by a "wrap around" type packing.

In the embodiment shown, this packing comprises a first sheet of cardboard or of an analogous material 4.

This sheet or blank 4 comprises three openings 5*a*, 5*b*, 5*c* which are substantially rectangular and whose dimensions are substantially superior to those of the bottom walls of the pots and substantially inferior to those of the upper rims of these pots.

In the embodiment shown, the blank 4 comprises a central panel 6 comprising the openings 5*a*, 5*b* and 5*c* and two pairs of side flaps 7*a*, 7*b* and 8*a*, 8*b*.

When it is laid flat, the blank 4 is substantially rectangular.

The openings 5*a*, 5*b* and 5*c* are arranged along a longitudinal direction D1.

The flaps 7*a* and 8*a* are substantially identical, placed on both sides of the central panel and hinged to the latter by means of folding lines, grooving lines or equivalent arranged along direction D1.

When the volumetric capacity of the blank 4 is generated, the flaps 7*a* and 8*a* form two side faces, placed opposite to one another, of the final product 1.

In the embodiment shown, the flaps 7*a* and 8*a* are rectangular and solid.

In other embodiments, not shown, the flaps 7*a* and 8*a* comprise equivalent or non equivalent openings making it possible to view the pots of the top layer 3, at least partially, and particularly the pot arranged in the middle of the top layer 3.

Flap 8*b* is hinged to flap 8*a* by means of a folding or grooving line substantially parallel to direction D1.

In the embodiment shown, flap 8*b* is rectangular and solid and, when the volumetric capacity of the blank 4 is generated, it forms the top face of the "wrap around" packing of the final product 1.

In other embodiments, not shown, flap 8*b* comprises at least one opening making it possible to view, at least partially, the top face of the pots of the top layer 3, and particularly of the pot arranged in the middle of this layer 3.

Flap 8*b* may also comprise elements such as a handle, holes or equivalent making it possible for the final product 1 to be seized and transported by the consumer.

Flap 7*b* is hinged to flap 7*a* by means of a folding or grooving line substantially parallel to direction D1.

Flap 7*b* forms a bonding tab for flap 8*b*, when the volumetric capacity of the blank 4 is generated.

The volumetric capacity of a blank 4 is generated in the following manner.

A blank 4 is laid flat and conveyed to a station 9 for installing the three pots of the bottom layer 2.

The three pots of the bottom layer 2 are placed above the openings 5*a*, 5*b* and 5*c* and the blank 4 is displaced upwards so as to maintain the three pots of the bottom layer 2 in their final relative position.

A sheet 10 of cardboard, plastic or any other equivalent material is then placed above the pots of the bottom layer 2, in a station 11 for installing an insert.

The assembly formed by the blank 4, the three pots of the bottom layer 2 and the insert sheet 10 is conveyed to a station 12 for installing the pots of the top layer 3.

Upon exiting station 12, flaps 7*a* and 8*a* are folded vertically at station 13, into a position substantially perpendicular to the central panel 6 and to the insert sheet 10 arranged above this panel 6, between the top layer 3 and the bottom layer 2.

Then, at station 14, flap 8*b* is folded horizontally, along with flap 7*b*.

The link between flap 7*b* and flap 8*b* may be obtained by bonding, heat welding, ultrasonic or high-frequency welding, cramping or any other equivalent method.

In the embodiment shown in FIG. 1, the "wrap around" type packing is such that the lower part of the pots of the bottom layer 2 is visible.

In other embodiments, not shown, the "wrap around" packing clasps the pots of the bottom layer 2 and of the top layer 3 in such a manner that the central panel 6 of the blank 4 is substantially solid and forms a bottom wall of the final product, with the pots of the bottom layer 2 resting on this bottom wall. Fastening means, such as slots, tabs or equivalent, make it possible to maintain the pots of the bottom layer 2 and of the top layer 3 in position in the final product 1.

In the embodiment shown, the stations 9, 11, 12, 13 and 14 are substantially aligned in a direction parallel to D1.

In other embodiments, the stations 9, 11, 12, 13 and 14 are not aligned, stations 9 and 11 being arranged, for example, along a direction substantially parallel or inclined with respect to that defined by stations 12, 13 and 14.

In the embodiment shown, the blank 4 is not symmetrical with respect to its median line parallel to Dl, with flaps 7*b* and 7*b* having different dimensions.

In another embodiment, not shown, flaps 7*b* and 8*b* are identical.

The number of pots arranged on the bottom layer is determined by a device 15 analogous to a toothed wheel in which the spacing between successive teeth corresponds to the overall dimensions of three pots, in the embodiment shown.

The device 15 makes it possible to space out and group three pots from a first pot supply line 16.

In the same way, the number of pots arranged on the top layer is determined by a device 17 analogous to device 15 making it possible to space out and group three pots from a second pot supply line 18.

The blank 4 is provided with three openings 5*a*, 5*b* and 5*c* making it possible to maintain up to six pots, i.e. three pots on the top layer 3 and three pots on the bottom layer 2.

In another embodiment, device 15 and/or device 17 make up removable units, with the operator choosing grouping and separation elements from a group of elements making it possible to form batches of two, three or more than three pots for the top layer 3 and the bottom layer 2.

In this case, the operator will also choose a blank 4 with corresponding dimensions.

In the embodiment shown, a final product 1 only comprises two layers of pots.

A number of layers greater than 2, three for example, may be provided for.

In this case, a device analogous to devices 15 and 17 makes it possible to arrange a third layer of pots, following the installation of a second insert, analogous to insert sheet 10.

The blank 4 may comprise fastening means such as foldable tabs or equivalent or even slots allowing for the lateral passage of the upper rims of the pots so as to slightly project outwards.

The first pot supply line 16 and the second pot supply line 17 stem, via diverting and steering elements 19*a*, 19*b*, from two substantially parallel pot conveyance lines 20*a* and 20*b*.

In lines 20*a* and 20*b*, the pots are individualised, i.e. not linked together by a frangible link or any other link.

A blanking station 21 is arranged at the upstream end of lines 20*a* and 20*b*.

Upstream from the blanking station 21, pairs of pots 22 are conveyed to station 21 so as to feed lines 20*a* and 20*b* after the blanking and separation of the pots of each pair.

Each pair of pots 22 is arranged perpendicularly with respect to its direction of travel towards station 21 such that the line of separation of the pots of each pair is parallel to the direction of travel and to the direction of conveyance of the individualised pots in lines 20*a* and 20*b*.

The blanking may be performed by a rotating and/or vibrating metal blade, by a pair of blades forming pincers, by circular shears, by a jet of water or any other equivalent method.

If necessary, a weakest line, comprising thinnings or holes, may be provided throughout a breadth comprising the line of separation provided for.

Figure 2:
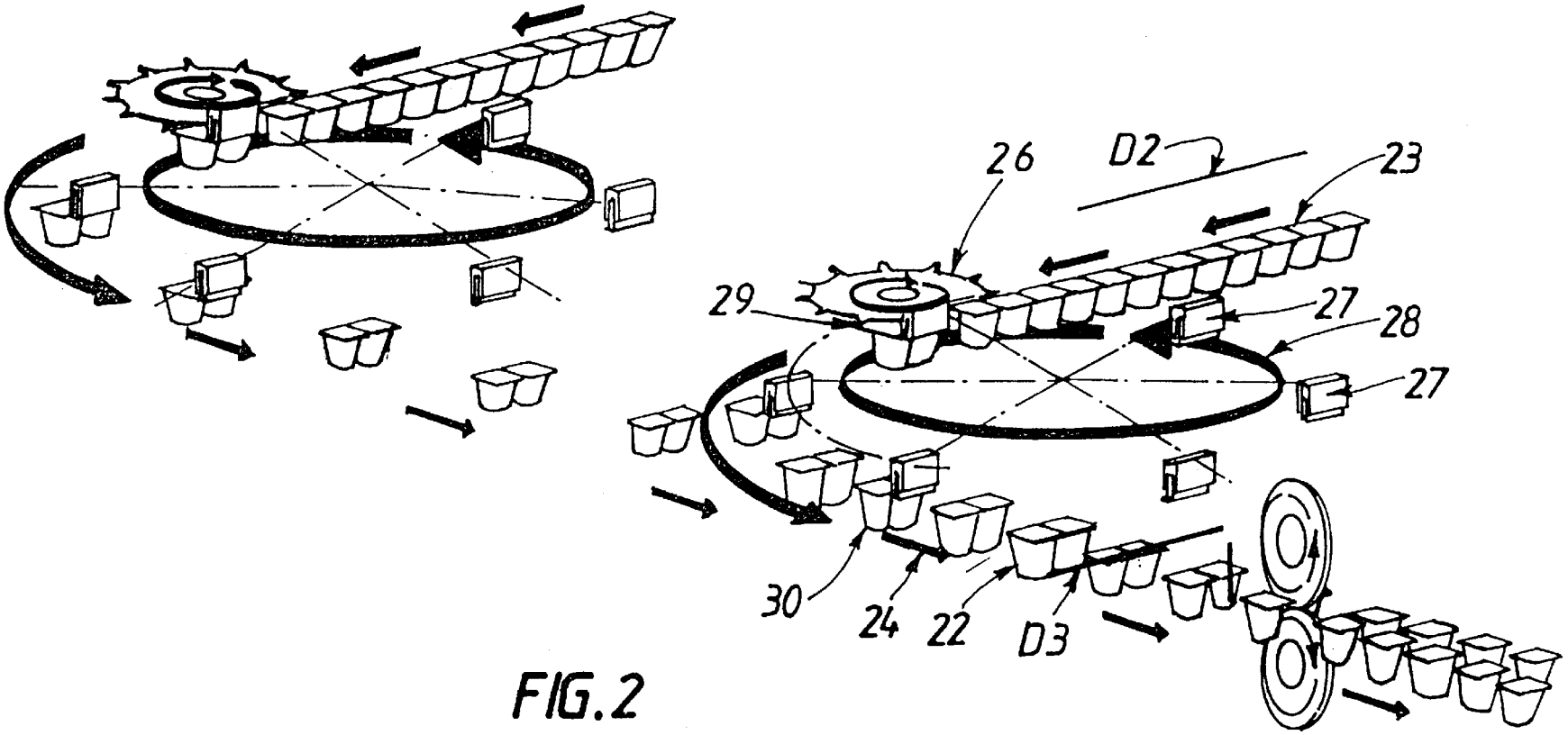
FIG. 2 is a detail view of FIG. 1.

The pairs of pots 22 are displaced, from a first substantially rectilinear feed track 23 to a second rectilinear feed track 24 forming an angle with said first track, by two devices 25*a*, 25*b* (see FIG. 2).

Each device 25*a*, 25*b* comprises means 26 for grouping pots in pairs, means 27 for grasping pairs of pots, means for driving the grasping means 27 along a closed circuit 28 comprising a station 29 where the pairs of pots are seized by the grasping means 27, located plumb with the first feed track 23, and a station 30 where the pairs of pots are released by the grasping means 27, located plumb with the second feed track 24.

At the seizing station 29, the pots are aligned in direction D2 of the first feed track 23, whereas at the releasing station 30, the pots of each pairs of pots are aligned in a direction D3 substantially perpendicular to the second feed track 24.

In the embodiment shown, direction D2 is substantially parallel to D3 and the first and second feed tracks are substantially flat and perpendicular.

In the embodiment shown, the pots are conveyed in pairs by devices 25*a* and 25*b*.

In other embodiments, not shown, the pots are conveyed in groups of more than two pots, the blanking means of station 21 then being designed to separate the pots of each group so as to form as many substantially parallel conveyance lines 20 as there are pots in a group conveyed by devices 25*a*, 25*b*.

In the embodiment shown, two devices 25*a*, 25*b* make it possible to convey pairs of pots, regularly spaced apart, towards the blanking station 21.

In other embodiments, not shown, more than two devices 25 are provided, possibly arranged on both sides of the direction of travel of the pairs of pots towards station 21.

The number of devices 25, the number of grasping means 27, the number of pots supported by each grasping means 27, as well as the transfer speeds, are determined according to the delivery rate required.

For example, when the pots are conveyed to the blanking station 21 in groups of four pots, two packaging machines of the type shown in FIG. 1 may be provided placed face to face.

Figure 3:
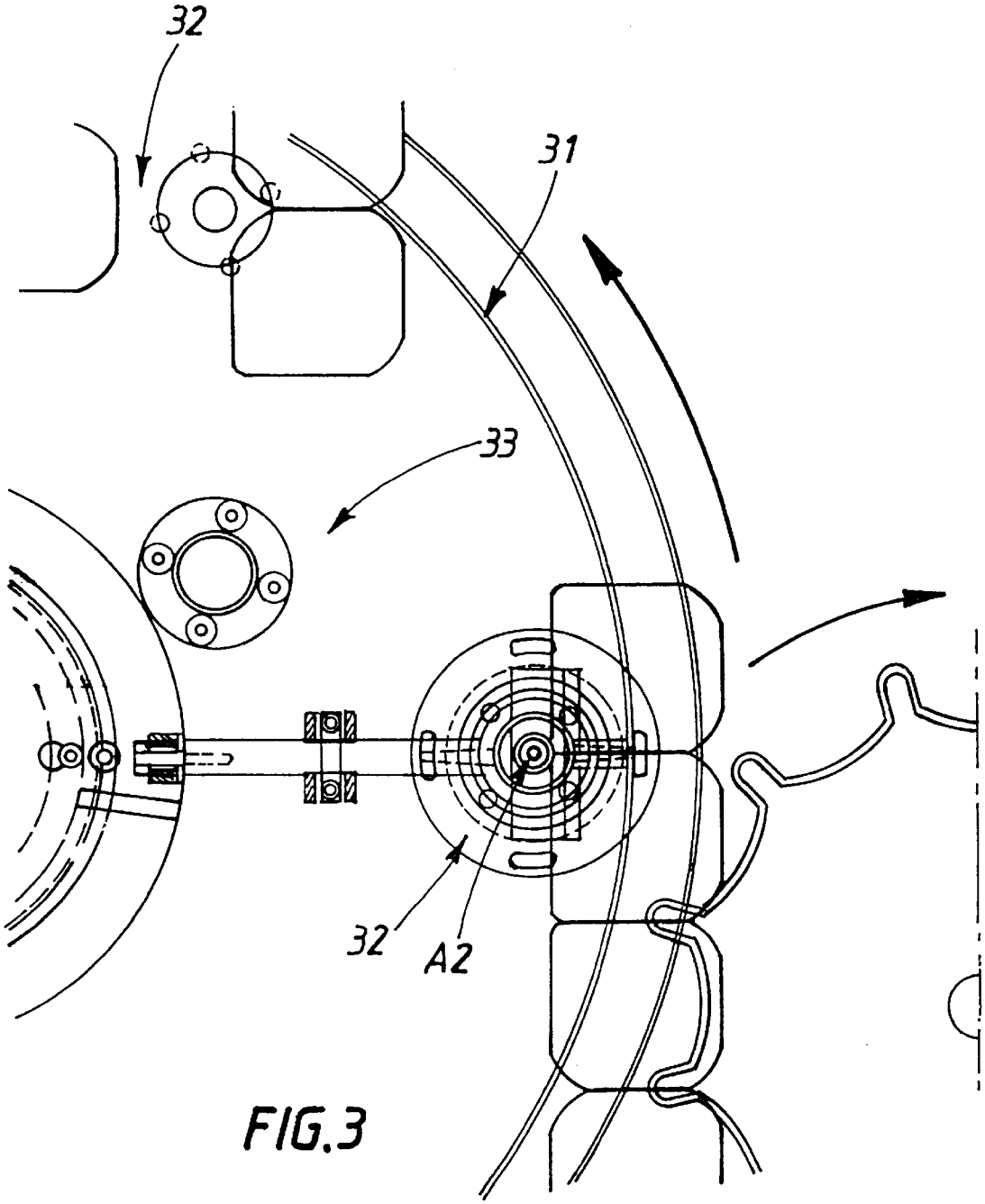
FIG. 3 is a top view of a circular transfer conveyor according to one embodiment of the invention.
Figure 4:
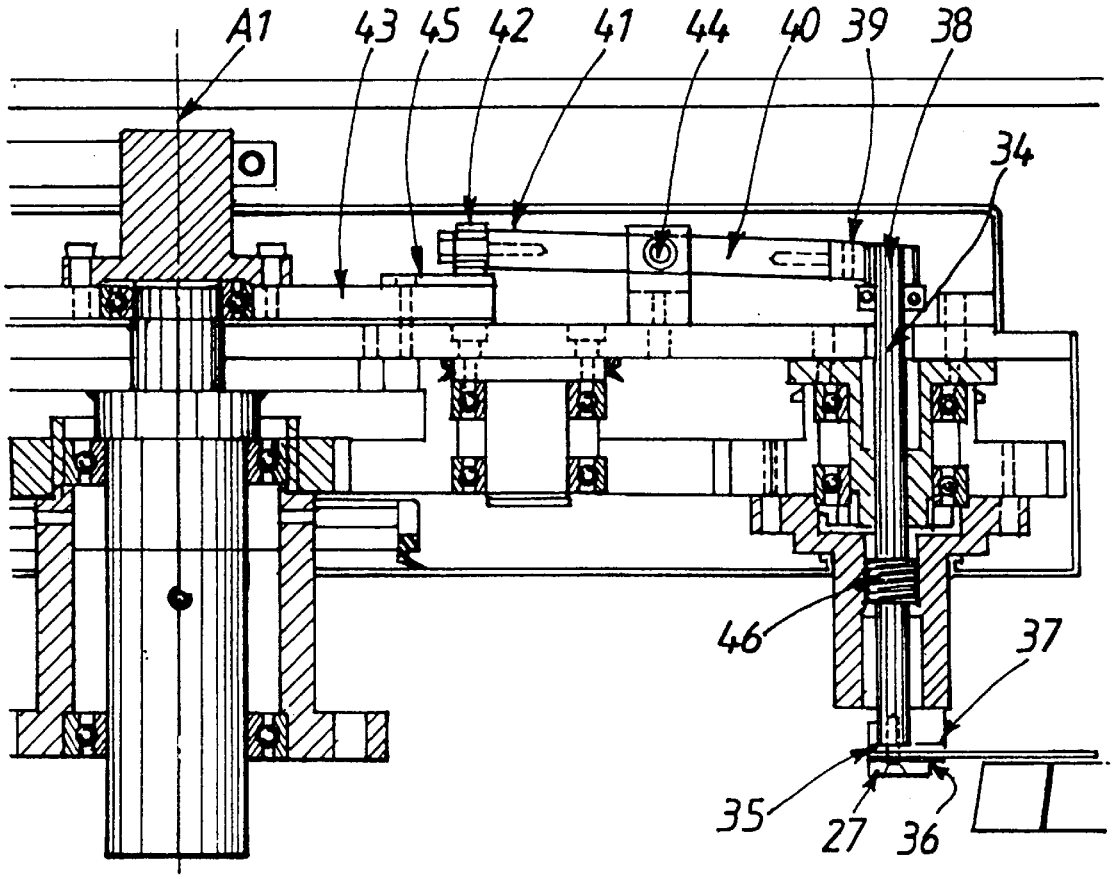
FIG. 4 is a sectional view of FIG. 3.

Reference will now be made to FIG. 3.

The means for driving the grasping means comprise a circular conveyor 31 with several carrier pinions 32.

In the embodiment shown, the circular conveyor 31 comprises six carrier pinions 32.

Three intermediate pinions 33 connect the main pinion of the circular conveyor to the carrier pinions 32 such that each carrier pinion 32 is driven into rotation with respect to the principal axis A1 of the circular conveyor along the closed circuit 28 and into rotation about its own specific axis A2 substantially parallel to Al.

Axis A2 is that of a substantially vertical rod 34 of which a first, lower end part 35 forms a supporting surface 36 for the bottom face of the upper rim of the pots, opposite to the top face carrying the lid.

This rod 34 is free to move vertically between two positions:

- a lower position in which the pots are released by the grasping means 27, at station 30 in particular. In this position, the distance between the supporting surface 36 and a surface 37 placed opposite to the carrier pinion 32 is superior to the thickness of the substantially flat upper rim of the pots;
- an upper position in which the pots are seized by the grasping means 27, at station 29 in particular. In this position, a part of the upper rim of the pots is gripped between the supporting surface 36 and surface 37.

The passage of the rod or slide 34 from the lower position to the upper position takes places in the following manner.

The second end part 38 of the rod 35 is integral with first end part 39 of a lever 40.

The other end part 41 of the lever 40 supports a roller 42 rolling on a fixed cam 43, a hinge 44 being arranged between the end parts 39 and 41 of the lever 40, substantially at the middle of the length of this lever 40.

A protuberance 45 arranged on the runway of the roller 42 displaces the lever 40 so as to rotate with respect to the hinge 44 and displaces the rod 34 from the upper position in which the pots are seized to the lower position in which they are released.

In the course of this displacement, an elastic device such as a spring 46, associated with the rod 34, is compressed.

When the roller 42 overshoots the protuberance 45, the resilience of the spring 46 drives the rod 34 from the lower position in which the pots are released to the upper position in which they are seized.

Those skilled in the art will easily understand that the protuberances 45 are placed on the runway of the roller 42 at positions corresponding to stations 29 and 30 for seizing and releasing the pots, respectively, on the closed circuit 28.

If necessary, end part 35 of the rod 34 is provided with a removable adapter comprising a supporting surface adapted to the type and number of pots to be conveyed from the first feed track 23 to the second feed track 24.

I claim:

1. A device for displacing articles from a first substantially rectilinear feed track (23) to a second substantially rectilinear feed track (24) forming an angle with said first track (23), said device comprising:

means (26) for grouping articles in batches of at least two articles;

means (27) for grasping the batches of articles formed;

means for driving said grasping means along a closed circuit (28) comprising:

a station (29) where the batches of articles are seized batchwise by the grasping means, at the end of the first feed track (23);

a station (30) where the batches of articles are released batchwise by the grasping means, at the beginning of the second feed track (24), at the seizing station (29), the articles of each batch of articles being aligned in a first direction of alignment substantially parallel to the first feed track (23), and at the releasing station (30), the articles of each batch of articles being aligned perpendicular to the second feed track (24), wherein the means for driving the grasping means (27) comprise a circular conveyor (31) with several carrier pinions (32), a means (27) for grasping batches of articles being secured to each carrier pinion (32) in a removable manner, wherein the circular conveyor (31) comprises a main driving shaft, intermediate pinions (33) connecting this main driving shaft to the carrier pinions (32), wherein each grasping means (27) comprises:

a slide (34) of which a first end (35) forms a clamp for grasping a batch of articles;

a lever (40) of which a first end (39) is associated with a second end (38) of the slide (34), a second end (41) of this lever (40) carrying a roller (42) rolling on a fixed cam (43), this lever (40) being arranged along a radial direction of the circular conveyor (31) and being capable of rocking in a tangential direction defined by a pin support (44 );

said fixed cam (43) comprising protuberances (45) on which the roller (42) passes, driving the slide (34) from an upper position in which the articles are seized to a lower position in which the articles are released.

2. A device according to claim 1, wherein in that the first direction of alignment is substantially identical to the second direction of alignment.

3. A device according to claim 1, wherein the first and second feed tracks (23,24) are substantially flat and perpendicular.

4. A machine for packaging articles, comprising at least one device according to claim 1.

5. A packaging machine according to claim 4, which further comprises a station (21) for separating batches of articles into individual articles, lines of separation of the articles being parallel to the direction of conveyance of the second feed track (24).

6. A machine according to claim 5, which further comprises elements (19*a*, 19*b*) for diverting and steering the individualized articles toward devices (15, 17) for grouping and spacing out articles.

7. A machine according to claim 4, which further comprises:

a line for supplying a blank (4) made of cardboard;

a station for installing an insert (10) above the first group of articles forming a bottom layer (2) of a final product (1);

a station (12) for installing a second group of articles, coming from grouping and spacing means (17), and forming a top layer (2) of the final product (1);

stations (13, 14) for folding and fastening side flaps (7*a*, 7*b*, 8*a*, 8*b*) of the blank (4), so as to form a pack of a final product (1).

* * * * *